US006134727A

United States Patent [19]

Hwang

[11] Patent Number: 6,134,727

[45] Date of Patent: Oct. 24, 2000

[54] FOLDING BED

[76] Inventor: Joo-Hwan Hwang, Dongkyung 4cha Apartment Gadong 408Ho, 384-2, Shinchun-Dong, Shinhung, Kyungki-Do, Rep. of Korea

[21] Appl. No.: 09/209,131

[22] Filed: Dec. 10, 1998

[30] Foreign Application Priority Data

Dec. 11, 1997 [KR] Rep. of Korea ..... 97-36691

[51] Int. Cl.[7] ..... A47C 17/64

[52] U.S. Cl. ..... 5/114; 5/110; 5/112

[58] Field of Search ..... 5/114, 110, 111, 5/112, 113, 129

[56] References Cited

U.S. PATENT DOCUMENTS

| | | | |
|---|---|---|---|
| 3,491,998 | 1/1970 | Lyon | 5/151 |
| 3,561,772 | 2/1971 | Curtess | 5/151 X |
| 3,596,906 | 8/1971 | Parmer | 5/154 X |

*Primary Examiner*—Terry Lee Melius
*Assistant Examiner*—Fredrick Conley
*Attorney, Agent, or Firm*—Nawrocki, Rooney & Sivertson, P.A.

[57] ABSTRACT

A folding bed is disclosed. A folding frame has a plurality of legs and a plurality of upper and lower connecting elements which connect the plurality of legs with one another. The plurality of legs include a first set of four legs which extend slantingly and upward through the upper connecting elements in a lengthwise direction of the bed and a second set of two legs which extend slantingly and upward through the upper connecting elements in a crosswise direction of the bed. A seat is fixed to the upper connecting elements and has a first set of four pockets into which the upper ends of the first set of four legs are inserted, respectively. A pair of support sheets are stitched to both sides of the seat, respectively. The pair of support sheets have a second set of two pockets into which the upper ends of the second set of two legs are inserted, respectively. The upper ends of the second set of two legs are fastened to the support sheets. A pair of guide bands are stitched to corner portions of the seat at one end of the bed, respectively. The other ends of the pair of guide bands are stitched to the pair of support sheets, respectively.

1 Claim, 5 Drawing Sheets

FOLDING BED

BACKGROUND OF THE INVENTION

1. Field of the Invention

The present invention relates to a folding bed, and more particularly, the present invention relates to a folding bed which can be folded to afford easy portability and has an improved structure as compared to a folding bed of the prior art, to allow a user keep a comfortable and tranquil posture upon lying in the bed.

2. Description of the Prior Art

Up to now, various types of a folding bed or a sofa-bed have been developed and used. However, these beds have complicated structures, so that folding procedures are much involved and portability and storage thereof are affected due to limitations in minimizing the volume of a bed. In addition, as a folding bed or a sofa-bed is manufactured to have a narrower width in view of portability, it is not uncommon to find the bed is not big enough to fully accommodate the whole body of a person, leaving a portion of the body hanging off the bed. Accordingly, the use of the bed becomes inconvenient. Also, in an extreme case, the user can fall out of the bed resulting in personal injury.

In the Korean Utility Model Publication No. 96-1441 filed by the applicant of the present invention, there is disclosed a folding bed to solve the problem described above. Referring to FIG. 1, the folding bed includes a seat 1 and a folding frame 2. The folding frame 2 has a plurality of legs 20 and a plurality of upper and lower connecting elements 30 which connect the plurality of legs 20 with one another. The plurality of legs 20 includes four legs having upper ends which extend slantingly and upward through the upper connecting elements 30 at corner portions and in a lengthwise direction of the bed. The plurality of legs 20 can be folded due to the fact that two adjacent and associated legs are also connected with each other substantially at their middle portions by a pin.

The seat 1 being made of fiber is fixed to the upper connecting elements 30 by fastening means such as bolts. The seat 1 has four pockets 1*a*, 1*b*, 1*c*and 1*d* which are formed at the corner portions of the bed and into which the upper ends of the four legs are inserted, respectively. A pair of guide bands 14 and 14' are stitched to two corner portions of the seat 1 at one end and run in the lengthwise direction of the bed, respectively. The other ends of the pair of guide bands 14 and 14' are stitched to the seat 1 at points where two upper connecting elements 30 adjacent to the other end of the bed are positioned parallel to each other. The pair of guide bands 14 and 14' pass through a pair of annular bands 15 and 15' which are stitched to the seat 1. A pair of support bands 16 are stitched to a lower surface and at a center portion of the seat 1 such that they cross each other. The drawing reference numeral 18 represents a binding string used for binding the bed which is folded for carrying or storage.

When a user lies in the seat 1 for sleep or rest, the pair of guide bands 14 and 14' prevent the user from falling out of the bed or a portion of the user's body such as the shoulder from hanging off the bed. Also, the pair of support bands 16 can prevent the seat 1 made of fiber, such as fabric, from excessive sagging. Therefore, a safety factor upon using the bed is increased.

However, the folding bed of the prior art constructed as mentioned above, suffers from defects in that since the pair of guide bands 14 and 14' are stitched to the seat 1 after passing through the pair of annular bands 15 and 15' and the seat 1 is fixed to the upper connecting elements 30 which are positioned adjacent to the one end of the bed by the separate fastening means such as bolts each having an eyelet, when a user lies in the seat 1 of the bed for sleep or rest, a weight of the user acts vertically and downward on the seat 1, and by this, the pair of guide bands 14 and 14' stitched to the seat 1 are expanded. Due to the weight of the user which acts continuously and vertically and the expansion of the pair of guide bands 14 and 14', a load is concentrated onto points where the seat 1 is fixed to the upper connecting elements 30. Therefore, the seat 1 is protruded upward by horizontal expanding force at the points where it is fixed to the upper connecting elements 30.

The protruded section of the seat 1 depresses a portion such as the pelvis or the back, of the body of the user who lies in the bed. Hence, inconvenience is caused to the user who sleeps and takes a rest for a long time, and reliability of the folding bed is deteriorated in that the user feels discomfort in some portions of the body after sleeping or taking a rest in an unstable posture.

SUMMARY OF THE INVENTION

Accordingly, the present invention has been made in an effort to solve the problems occurring in the prior art, and an object of the present invention is to provide a folding bed in which a pair of support sheets each having a pocket are stitched to both sides of a seat, respectively, and upper ends of two legs are inserted into the pockets of the pair of support sheets, respectively, the upper ends extending slantingly and upward through upper connecting elements in a crosswise direction of the bed. The folding bed uniformly disperses a weight of a user, which acts downward on the seat, over the entire area of the seat. By this, the folding bed can prevent a portion of the seat from being protruded by horizontal expanding force generated at points where the seat is fixed, and the user can keep a comfortable and tranquil posture upon lying in the bed for sleep or rest, whereby reliability of the bed can be enhanced.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
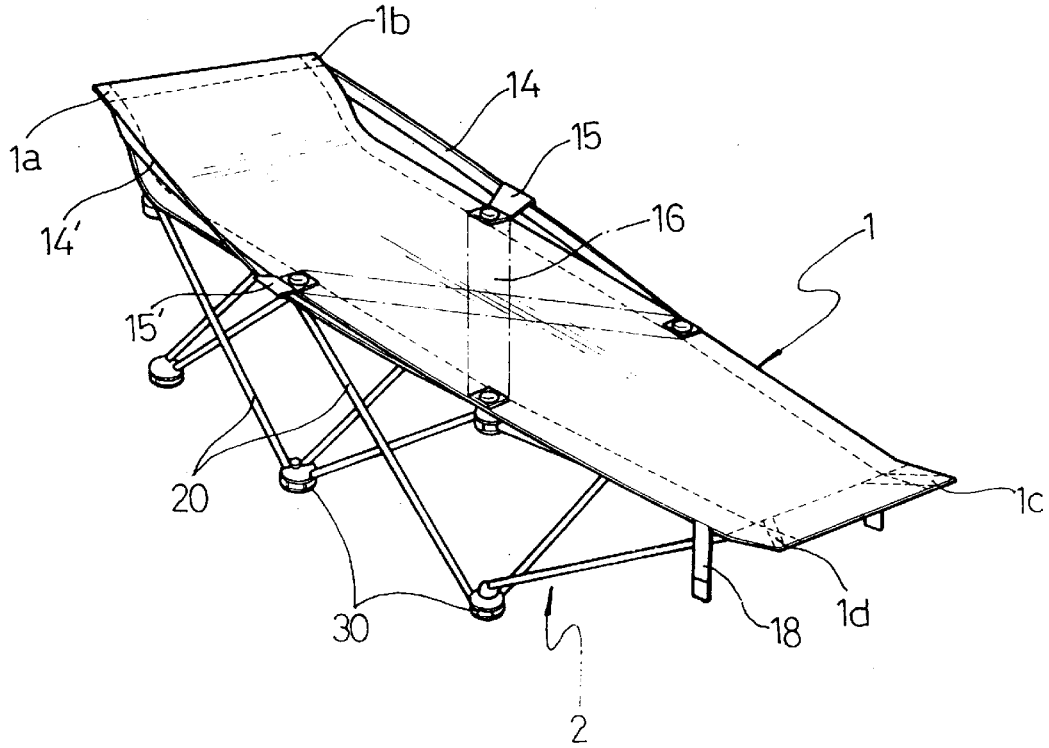
FIG. 1 is a perspective view of a folding bed of the prior art.
Figure 2:
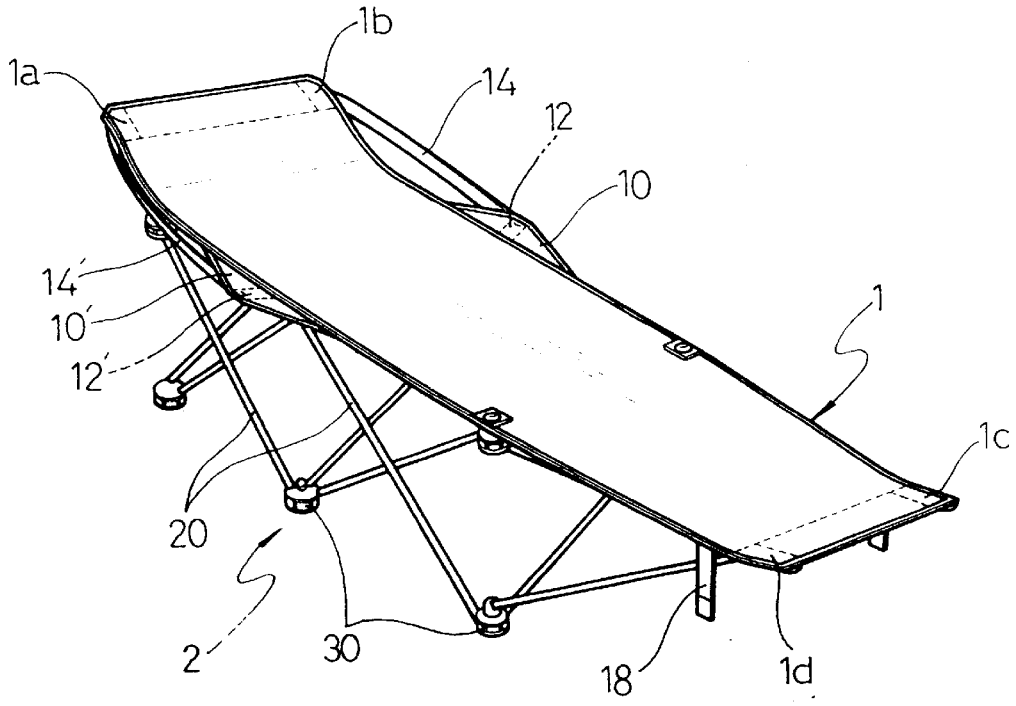
FIG. 2 is a perspective view of a folding bed in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Referring to FIGS. 2 through 6, a folding bed of the present invention includes a seat 1 and a folding frame 2. The folding frame 2 has a plurality of legs 20 and a plurality of upper and lower connecting elements 30 which connect the plurality of legs 20 with one another. The plurality of legs 20 include a first set of four legs 20*a*, 20*b*, 20*c*and 20*d*, the upper ends of which extend slantingly and upward through the upper connecting elements 30 at corner portions and in a lengthwise direction of the bed and a second set of two legs, the upper ends 22 and 22' of which extend slantingly and upward through the upper connecting elements 30 at middle portions and in a crosswise direction of the bed. The plurality of legs 20 can be folded due to the fact that two adjacent and associated legs are also connected with each other substantially at their middle portions by a pin.

The seat 1 is fixed to the upper connecting elements 30 by a pair of fastening means such as bolts. The seat 1 has a first set of four pockets 1*a*, 1*b*, 1*c*and 1*d* which are formed at the corner portions of the bed and into which the upper ends of the first set of four legs 20*a*, 20*b*, 20*c*and 20*d*are inserted, respectively. A pair of support sheets 10 and 10' are stitched to both sides of the seat 1, respectively. The pair of support sheets 10 and 10' have a second set of two pockets 12 and 12', respectively, into which the upper ends 22 and 22' of the second set of two legs are inserted, respectively. The upper ends 22 and 22' of the second set of two legs are fastened to the support sheets 10 and 10' by fastening means such as bolts 17 after being inserted into the second set of two pockets 12 and 12' . A pair of guide bands 14 and 14' are stitched to two corner portions of the seat 1 at one end and run in the lengthwise direction of the bed, respectively. The other ends of the pair of guide bands 14 and 14' are stitched to the pair of support sheets 10 and 10', respectively. The drawing reference numeral 18 represents a binding string used for binding the bed which is folded for carrying or storage.

Hereinafter, operations of the folding bed constructed as mentioned above will be described in detail.

Figure 3:
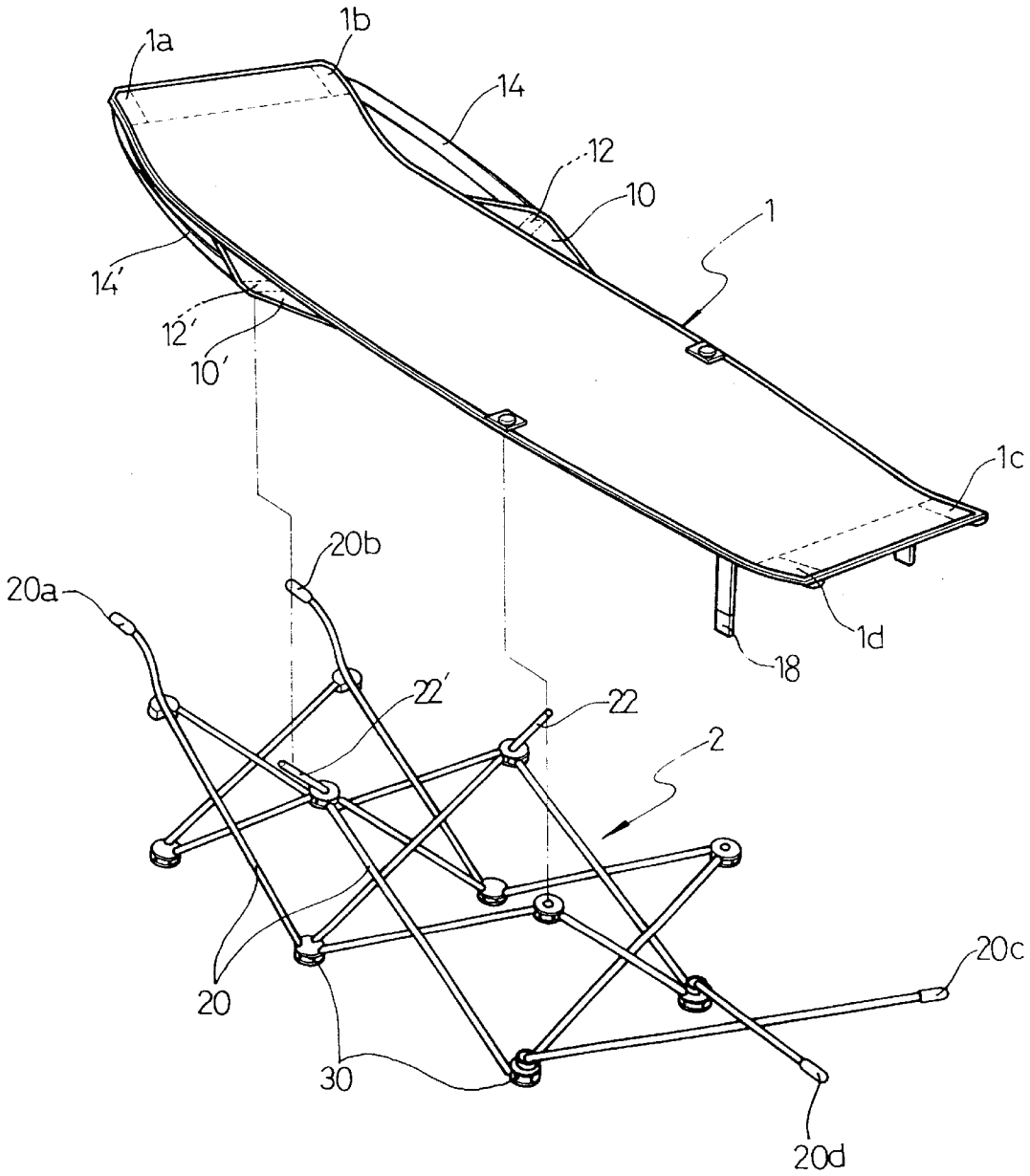
FIG. 3 is an exploded perspective view of the folding bed of FIG. 2.
Figure 4:
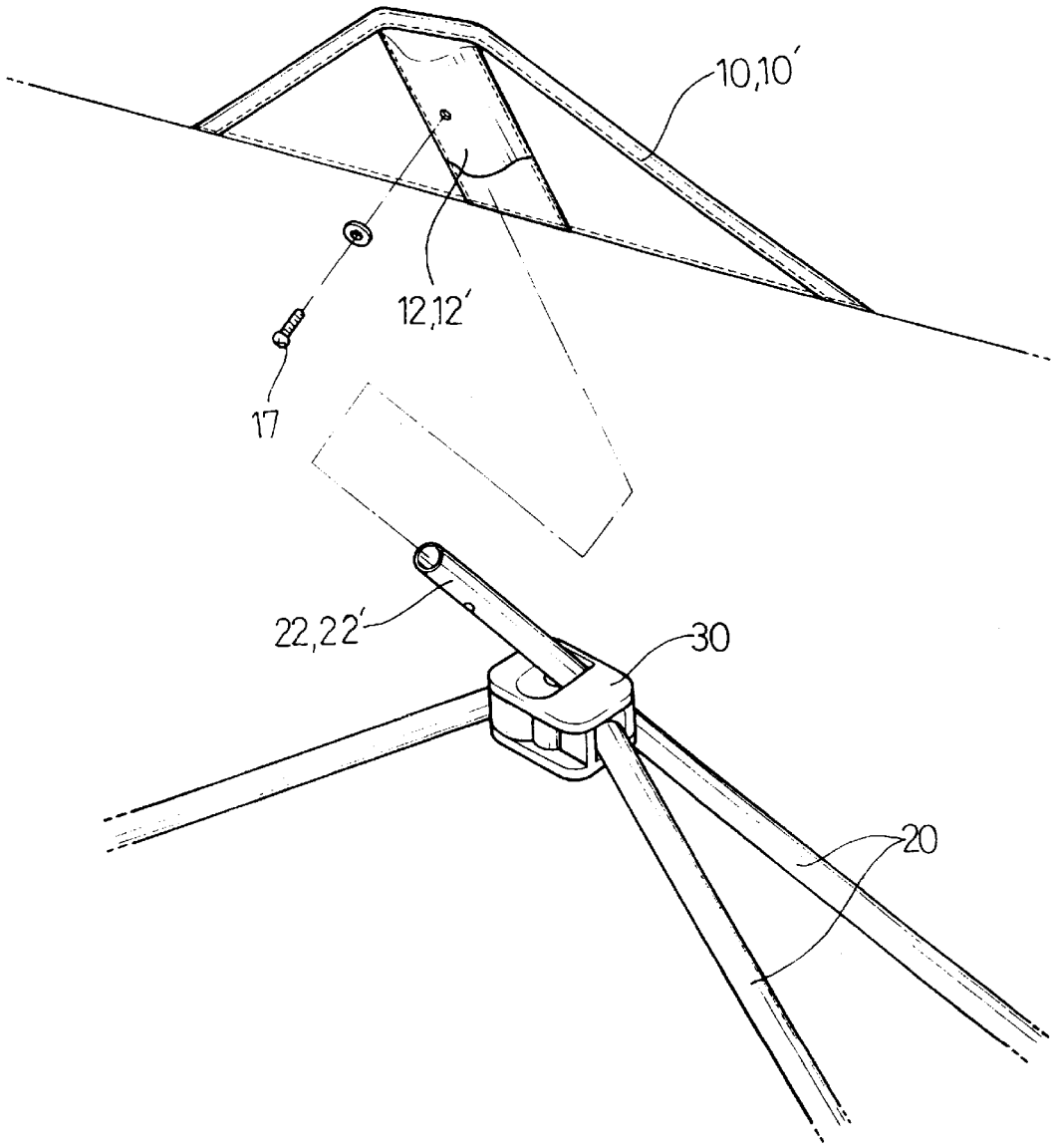
FIG. 4 is an exploded perspective view illustrating main components of the folding bed according to the present invention.
Figure 5:
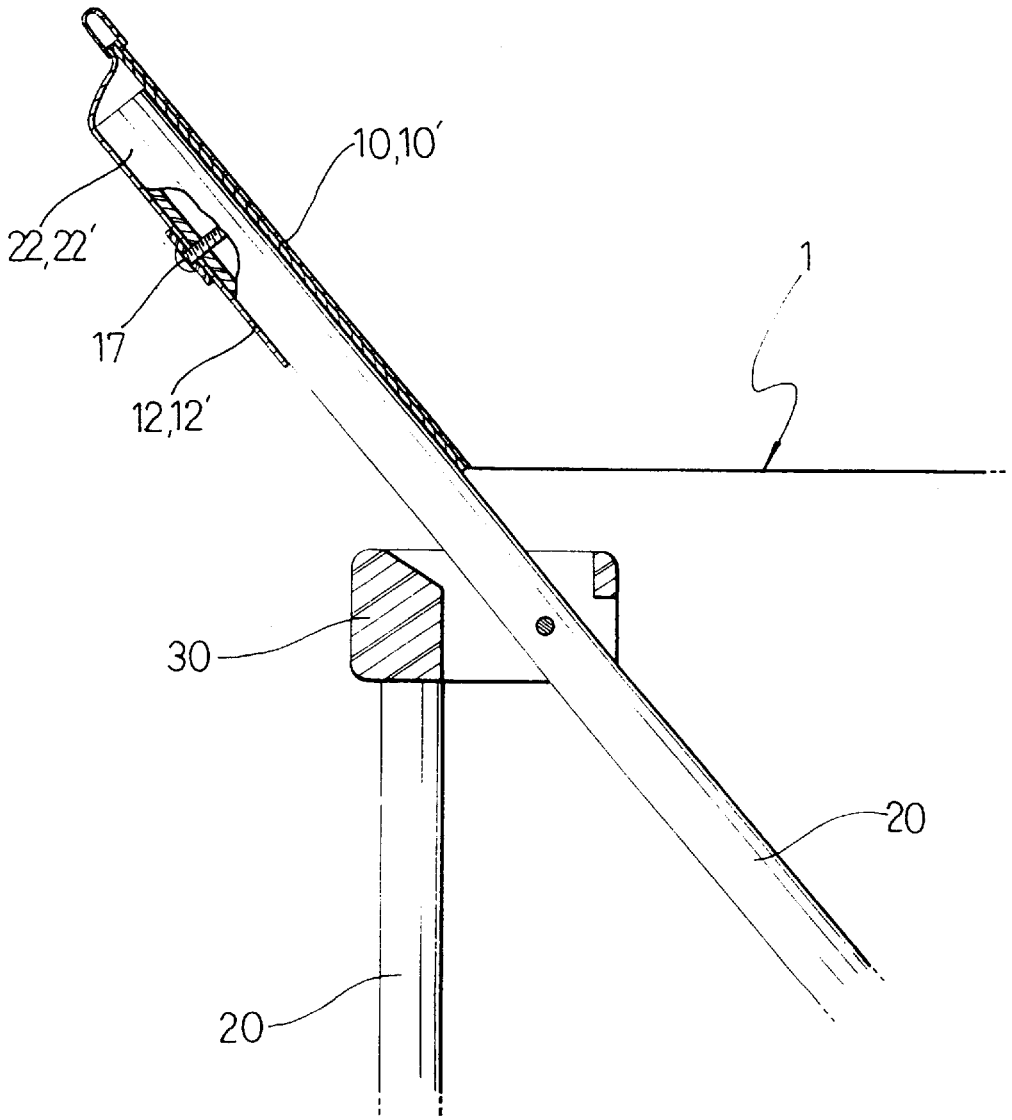
FIG. 5 is a cross-sectional view of the main components which are in an assembled state.
Figure 6:
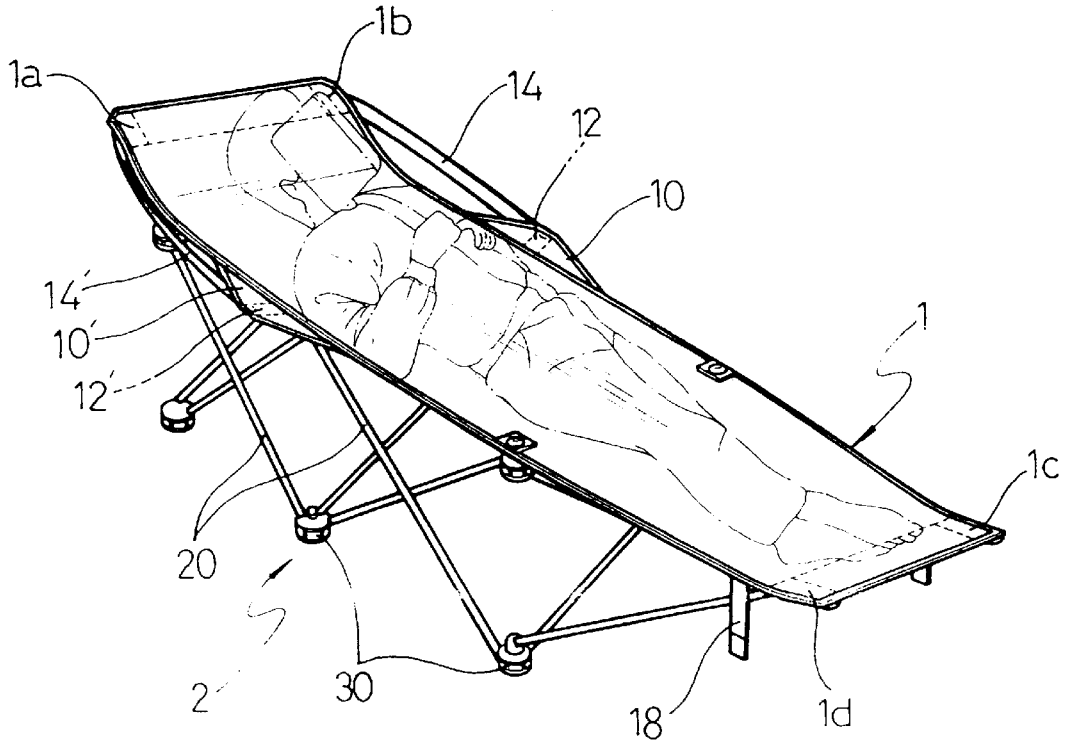
FIG. 6 is a perspective view illustrating the folding bed which is in use.

First, as shown in FIGS. 3 through 5, when manufacturing the folding bed of the present invention, the pair of support sheets 10 and 10' having the second set of two pockets 12 and 12' which are formed on lower surfaces thereof, are stitched to both sides of the seat 1, respectively. Then, the pair of guide bands 14 and 14' having a predetermined length are stitched to two corner portions of the seat 1 at one end and run in the lengthwise direction of the bed, respectively. Further, the other ends of the pair of guide bands 14 and 14' are stitched to the pair of support sheets 10 and 10', respectively. Thereafter, the seat 1 is assembled to the folding frame 2 such that the upper ends 22 and 22' of the second set of two legs 20 of the folding frame 2 are inserted into the second set of two pockets 12 and 12' of the pair of support sheets 10 and 10', respectively. In this way, the folding bed can be manufactured in an easy and simple manner.

When using the folding bed manufactured as described above, the folding bed is unfolded after being moved to a proper place. At this time, if a user lies in the seat 1 of the bed for sleep or rest, the pair of guide bands 14 and 14' disposed at both sides of the seat 1 prevent the user from falling out of the bed or a portion of the user's body such as the shoulder from hanging off the bed. Therefore, it is possible to obtain effects which are the same as those of the folding bed described in the Korean Utility Model Publication No. 96-1441 filed by the applicant of the present invention. In addition, by the present invention, a load which is induced by a weight of the user and acts downward on the seat 1 is uniformly dispersed over the entire area of the seat 1 by the pair of support sheets 10 and 10' and the upper ends 22 and 22' of the legs 20. Accordingly, a portion of the seat 1 is prevented from being protruded upward, and the user can keep a comfortable and tranquil posture upon lying in the bed for sleep or rest.

As a result, according to the present invention, advantages are provided in that since a load which is induced by a weight of a user and acts downward on a seat is uniformly dispersed over entire area of the seat by a pair of support sheets stitched to both sides of the seat, respectively, and upper ends of legs, inserted into the pair of support sheets, respectively, it is possible to prevent a portion of the seat from being protruded upward at points where it is fixed to a folding frame, and the user can keep a comfortable and tranquil posture upon lying in the bed for sleep or rest, whereby reliability of the folding bed is enhanced.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A folding bed comprising:

a folding frame having a plurality of legs and a plurality of upper and lower connecting elements which connect the plurality of legs with one another, the plurality of legs including a first set of four legs, upper ends of which extend slantingly and upward through the upper connecting elements at corner portions and run in a lengthwise direction of the bed and a second set of two legs, upper ends of which extend slantingly and upward through the upper connecting elements at middle portions and in a crosswise direction of the bed;

a seat fixedly assembled to the folding frame and having a first set of four pockets which are formed at the corner portions of the bed and into which the upper ends of the first set of four legs are inserted, respectively;

a pair of support sheets secured to both sides of the seat, respectively, and having a second set of two pockets into which the upper ends of the second set of two legs are inserted, respectively, the upper ends of the second set of two legs being fastened to the support sheet by fastening means; and a pair of guide bands being secured to the corner lengthwise direction, respectively, and other ends secured to the pair of support sheets, respectively.

* * * * *